United States Patent [19]

Horie et al.

[11] 4,013,472

[45] Mar. 22, 1977

[54] PHOTOGRAPHIC LIGHT-SENSITIVE MATERIAL

[75] Inventors: Ikutaro Horie; Kameji Nagao, both of Minami-ashigara, Japan

[73] Assignee: Fuji Photo Film Co., Ltd., Minami-ashigara, Japan

[22] Filed: Jan. 16, 1975

[21] Appl. No.: 541,467

[30] Foreign Application Priority Data

Jan. 16, 1974 Japan ..... 49-8123

[52] U.S. Cl. ..... 96/67; 96/50 PL; 96/87 A; 96/92; 96/94 R; 96/114; 96/114.5

[51] Int. Cl.[2] ..... G03C 1/76

[58] Field of Search ..... 96/67, 50 PL, 87 A, 96/92, 94 A, 114, 114.5

[56] References Cited

UNITED STATES PATENTS

| | | | |
|---|---|---|---|
| 3,754,924 | 8/1973 | De Geest et al. | 96/67 |
| 3,864,132 | 2/1975 | Rasch et al. | 96/67 X |

*Primary Examiner*—Mayer Weinblatt

*Attorney, Agent, or Firm*—Sughrue, Rothwell, Mion, Zinn & Macpeak

[57] ABSTRACT

A silver halide photographic light-sensitive material in which a surface layer thereof contains an inorganic material comprising as a main component alumina-magnesium silicate to improve upon the characteristics of the surface.

7 Claims, No Drawings

PHOTOGRAPHIC LIGHT-SENSITIVE MATERIAL

BACKGROUND OF THE INVENTION

1. Field of the Invention

The present invention relates to a silver halide photographic material which has especially improved surface layer characteristics.

2. Description of the Prior Art

Commonly used photographic light-sensitive materials have at least one silver halide photographic emulsion layer on a support. The surface layer or the outermost layer of such materials is usually a light-insensitive surface-protecting layer coated on an emulsion layer, although in some exceptional cases the outermost layer thereof is a silver halide light-sensitive emulsion layer. When all emulsion layers are present only on one side of the support, the other side of the support is often provided with a light-insensitive backing layer. The above-mentioned surface layer or outermost layer, e.g., silver halide emulsion layer, a protecting layer and a backing layer, contains a hydrophilic colloid and/or hydrophobic polymer compounds as a binder.

When such photographic materials are put in an atmosphere of high humidity or high temperature, especially under the circumstances of high temperature and high humidity, the adhesiveness or tackiness of the surface thereof increases tends to cause the surface to adhere easily to another body in contact with this surface. Various disadvantages are often caused by this adhesive phenomenon which takes place between different parts of the surface of a photographic material, or between the surface of a photographic material and another surface when allowed to stand in contact with each other in the course of manufacturing a photographic material, taking a photograph, processing a photographic material, projecting film or storing the material. This tendency of such adhesive phenonmenon appears prominently when the surface layer of a photographic material contains hygroscopic or tacky compounds.

As a method for solving this problem, the so-called matt layer-making method is well known, wherein the presence of fine powders of an inorganic compound such as silica, barium sulfate, kaolin, calcium carbonate, etc., or presence of fine powders of an organic compound such as cellulose acetate propionate, polymethylmethacrylate, polystyrene, polytetrafluoroethylene, etc., are incorporated in the surface layer. The method causes the coaseness of the surface to increase and results in a decrease in the adhesiveness of the surface. However, this matt layer-making method is accomplished by a few undesirable side effects described below. Namely, (i) a homogeneously coated-layer can not be obtained because these fine powders easily aggregate in a coating solution, (ii) the photographic materials tend to be damaged and are more difficult to drive in a camera or projector than if fine powders of the above compounds were not present because of the decrease in slipping ability of the surface, (iii) the transparency of photographic materials after processings is reduced by the presence of fine powders of the above compounds, (iv) the granularity of an image is degraded by the presence of fine powders of the above compounds, and the like.

The conducting of another method wherein a surface active agent containing a perfluoroalkyl group, a wax or silicone is present in the surface layer in order to improve the slipping ability to result in a decreased adhesiveness is also accompanied by undesirable side effects of, for example, a reduction in an anti-static power of a photographic material to result in increased static marks, having adverse effects on the photographic characteristics, a decrease in transparency of the processed photographic material and the like.

Therefore, a new means of improving the adhesion resistance of photographic materials without the above-described deleterious side effects has been desired.

SUMMARY OF THE INVENTION

An object of the present invention is to provide a photographic light-sensitive material having improved adhesive resistance.

Another object of the present invention is to provide a photographic light-sensitive material wherein the adhesive resistance thereof is improved unaccompanied by the above-described bad side effects.

These and other objects of the present invention will become apparent from the following detailed descriptions.

The above-described objects are attained with a photographic light-sensitive material having a surface layer thereon containing an inorganic material comprising alumina-magnesium silicate as a main component.

DETAILED DESCRIPTION OF THE INVENTION

The inorganic material employed in the present invention, which contains as a main component alumina-magnesium silicate, should contain as a main component $SiO_2$, MgO and $Al_2O_3$, and also can contain other metal oxides and a small amount of water as additional components e.g., in an amount up to about 30% by weight. A preferred total of the $SiO_2$, MgO and $Al_2O_3$ contents is greater than about 70% by weight.

Materials having the following composition have been found to very useful;

| | | |
|---|---|---|
| $SiO_2$ | about 30 | – about 90 wt % |
| MgO | about 1 | – about 40 wt % |
| $Al_2O_3$ | about 0.5 | – about 20 wt % |

wherein the total of their contents in a range of about 70 to 100 wt%.

Particularly preferable compounds which can be employed herein have the following compositions;

| | |
|---|---|
| $SiO_2$ | 40 – 70 wt % |
| MgO | 10 – 35 wt % |
| $Al_2O_3$ | 0.5 – 10 wt% |

wherein the total of their contents is in the range of 75 to 100 wt%.

As metal oxides other than $SiO_2$, MgO and $Al_2O_3$, mention may be made of $Na_2O$, $K_2O$, CaO, BaO, $TiO_2$, $Fe_2O_3$ and the like.

Specific examples of inorganic materials containing as a main component alumina-magnesium silicate which can be used in the present invention are the following commercially available materials:

1. Barasym NAS-100 (manufactured by Baroid Division NL Industries Inc., Texas USA)

Composition— $SiO_2$:45.4%, MgO:26.7%, $Al_2O_3$:7.4l% $Na_2O$:3.3%, $H_2O$:8.9% by weight.

2. Veegum (manufactured by R. T. Vanderbilt Co., Inc., New York, USA)
   Composition— $SiO_2$:61.1%, MgO:13.7%, $Al_2O_3$:9.3%, CaO:2.7%, $Na_2O$:2.5%, $H_2O$:7.2% by weight.
3. Bilt-Cote (manufactured by R. T. Vanderbilt Co., Inc., New York, USA)
   Composition— $SiO_2$:48.7%, MgO:25.6%, $Al_2O_3$:0.6%, CaO:6.3%, $Na_2O$:1.7% by weight.
4. Talc (manufactured by Kihara Kasei Co., Ltd. Japan)
   Composition— $SiO_2$:61.5%, MgO:31.6%, $Al_2O_3$:0.8%, $Fe_2O_3$:0.4%, CaO:0.6% by weight.

Useful inorganic materials containing as a main component alumina-magnesium silicate which can be employed in the present invention are those which form grains having a means diameter ranging from about 0.3 to 10 microns, preferably from 0.5 to 3 microns, when they are dispersed into water.

The inorganic material employed in the present invention begins to exhibit an improvement upon the adhesive resistance of a surface layer when used in an amount of 1 gram or so per 100 g of the binder in the surface layer. A good result can be obtained when the inorganic material is used in a concentration of more than 2.5 g per 100 g of the binder. Although the upper limit of the amount of such an inorganic material added is not critical, it can be effectively used in an amount of not more than about 15 g per 100 g of the binder if the transparency of the finished photographic material is taken into account.

The inorganic material which can be employed in the present invention can be applied to all kinds of silver halide photographic light-sensitive materials. The surface layer can contain as a binder hydrophilic colloids and/or hydrophobic polymer compounds. All compounds which are usually contained in a surface layer of photographic materials can be employed in such hydrophilic colloids and hydrophobic polyner compounds.

Suitable examples of hydrophilic colloids which can be used as a binder in the present invention are proteins such as gelatin, colloidal albumin, casein etc, cellulose derivatives such as caboxy-methylcellulose, hydroxyethylcellulose, etc.; polysaccharide derivatives such as agar, sodium alginate, starch derivatives, etc.; synthetic hydrophilic colloids such as polyvinyl alcohol, polyvinyl pyrrolidone, acrylic copolymers, polyacrylamide, polyacrylamide derivatives etc. Mixtures of two or more compatible colloids described above can be employed herein, if desired. Of the above-described colloids, gelatin is quite commonly used, and the substitution of part of the gelatin with synthetic polymer compounds can also be advantageous. Moreover, the so-called gelatin derivatives: that is, the reaction products of the functional groups contained in the gelatin molecule such as the amino, imino, hydroxy and carboxyl groups with a compound containing at least one functional group which is reactive with one of the above functional groups of gelatin; and grafted compounds which are obtained by grafting polymer chains of other polymer compounds onto gelatin can be employed.

Compounds containing at least one functional group reactive with one of the above functional groups of gelatin include, for example, isocyanates, acid chlorides and acid anhydrides as disclosed in U.S. Pat. No. 2,614,928; acid anhydrides as disclosed in U.S. Pat. No. 3,118,766; bromoacetates as disclosed in Japan Patent Publication No. 3,514/64; phenylglycydyl ethers as disclosed in Japanese Patent Publication No. 26,845/67; vinylsulfonates as disclosed in U.S. Pat. No. 3,132,945; N-allylvinyl-sulfonamides as disclosed in British Pat. No. 861,414; maleinimides as disclosed in U.S. Pat. No. 3,186,846; acrylonitriles as disclosed in U.S. Pat. No. 2,594,293; polyalkylene oxides as disclosed in U.S. Pat. No. 3,312,553; epoxides as disclosed in Japan Patent Publication No. 26,845/67; acid esters as disclosed in U.S. Pat. No. 2,753,639; and alkane sultones as disclosed in British Pat. No. 1,033,189.

Polymer compounds which can be graft-polymerized with gelatin are described, for example, in U.S. Pat. Nos. 2,763,625 and 2,831,767 and *Polymer Letters*, 5 595 (1967), and *Phot. Sci. Eng.* A-1, 9, 3199 (1971). A wide variety of vinyl polymers or copolymers containing vinyl monomers such as an acrylic acid, methacrylic acid, an acrylic acid ester, acrylamide, acrylonitrile, a methacrylic acid ester, methacrylamide. A methacrylonitrile and styrene can be preferably employed as such polymer compounds. Of the above vinyl polymers, hydrophilic vinyl polymers which are compatible with gelatin, for example, homopolymers or copolymers containing acrylic acid, acrylamide, hydroxyalkyl acrylates, or/and hydroxylkylmethacrylates, are preferred for use.

Suitable examples for hydrophobic colloids which can be used as a binder in the present invention are cellulose derivatives such as cellulose triacetate, cellulose diacetate, cellulose acetate phthalate, hydroxypropylmethyl cellulose acetate, hydroxymethyl cellulose hexahydrophthalate, cellulose acetate tetrahydrophthalate; polycondensation type synthetic polymer compounds such as condensation polymers prepared from various glycols and terephthalic acid or isophthalic acid, and condensation polymers prepared from formaldehyde and cresol, salicylic acid or oxyphenyl acetate; homopolymers of vinyl acetate, acrylic acid, methacrylic acid or styrene caboxylic acid monomers; copolymers of the above monomers and acrylic acid esters, methacrylic acid esters or styrene; copolymers of maleic anhydride and vinyl chloride, vinyl acetate, styrene or vinyl alkyl ethers, the ring opened half esters or amides of maleic anhydride copolymers and addition polymerization type aynthetic polymer compounds which are prepared from monomers having polymerizable unsaturated bonds such as copolymers of styrene sulfonic acid or styrene carboxylic acid and vinyl alkyl ethers or acrylonitrile. These compounds are hardly or slightly soluble in water, but highly soluble in alkaline aqueous solutions.

When care must be taken in the processing of a photographic material to avoid excess swelling, scratches and peeling-off, it is advantageous to harden the binder in the surface layer. Commonly used and well-known hardners are employed for this purpose. Examples of such hardeners include chrome alum, aldehyde compounds, N-methylol compounds, ketone compounds, carboxylic acid derivatives, sulfonic acid esters and halogenated sulfonyl compounds, active halogen containing compounds, epoxy compounds, aziridines, active olefin-containing compounds, isocyanates, carbodiimides and the compounds containing in a molecule not less than two of the above types of functional groups, which are described in, for example, C. E. K. Mees & T. H. James *The Theory of the Photographic Process* Third Edition, page 54–60, Macmillan Co. (New York); U.S. Pat. Nos. 2,586,168; 2,725,294; 2,725,295; 2,732,303; 2,732,316; 2,983,611, 3,017,280; 3,091,537; 3,100,704; 3,103,437; 3,232,763; 3,232,764; 3,288,775; 3,316,095; 3,321,212, 3,490,911; 3,543,292; 3,635,718; 3,642,486;and British Pat. Nos. 974,723; 994,869; 1,167,027; etc.

The surface layer can contain a surface active agent to facilitate the coating of the surface layer. All of the commonly used coating assistants in the manufacturing of photographic materials can be advantageously employed as such surface active agents. These coating assistants which can be advantageously used include acidic group-containing anionic surface active agents containing a carboxylic acid group, a sulfonic acid group, a phosphoric acid group, a sulfuric acid ester group, a phosphoric acid ester group; etc.; amphoteric surface active agents of the carboxylic acid type, sulfonic acid type, sulfuric acid ester type, phosphoric acid ester type, etc.; cationic surface active agents; nonionic surface active agents of the polyalkylene oxide series, polyglycerin series, etc.; and natural surface active agents such as saponin. In addition, surface active agents have the action of allowing photographic processing solutions to uniformly wet the surface of a photographic material. Further, certain surface active agents exhibit an antistatic effect.

The usual agents added to the surface layer of a photographic material can also be added to the surface layer herein, for example, a slipping agent such as liquid paraffin, a polysiloxane, etc., within a range which hardly affects the transparency of the surface layer; perfluoroalkyl group-containing compounds within a range hardly affecting the anti-static characteristics; and materials capable of selectively absorbing light such as ultraviolet light-absorbing agents and dyes can be added to the surface layer herein, if desired.

A suitable thickness of the surface layer of this invention can range of about 0.1 to 5 $\mu$, preferably 0.5 to 2 $\mu$.

The silver halide photographic light-sensitive material used in the present invention has at least one silver halide emulsion layer on a support, and is characterized by the inorganic material containing alumina-magnesium silicate as a main component in the surface layer thereof. The elements which form the silver halide photographic light-sensitive material used in the present invention, that is, the support, silver halide emulsion layers and light-sensitive auxiliary layers such as protecting, filter, intermediate, anti-halation and back layers when necessary, include any of the photographic elements which are well known to one skilled in the art.

Preferred supports which can be employed in the present invention include cellulose ester films such as cellulose nitrate films, cellulose acetate films, etc., polyester films such as polyethylene terephthalate films, polyvinyl acetal films, polyvinyl chloride films, polystyrene films, polycarbonate films, baryta papers, polyethylene-coated papers, films and the like.

Preferred silver halide emulsions which can be used in the present invention include any emulsion wherein silver halide particles are dispersed in a hydrophilic polymer binder. Preferred silver halides which can be used herein include silver bromide, silver chlorobromide, silver chloride and the like. Preferred hydrophilic polymer binders which can be used herein include gelatin and the above-described hydrophilic colloids. Silver halide emulsions can contain the so-called converted halide type silver halide particles as disclosed in U.S. Pat. No. 3,622,218; British Pat. No. 635,841; and so on. The halogen composition of silver halide and the grain size thereof are not restricted and can be varied as described.

Silver halide emulsions used in the present invention can be sensitized using active gelatin as disclosed in U.S. Pat. Nos. 1,574,944; 1,623,499; 2,410,689; etc., or sulfur compounds. The emulsions can also be sensitized using noble metal salts such as the salts of palladium, gold, etc., as disclosed in U.S. Pat. Nos. 2,448,060; 2,399,083; 2,642,361; etc. In addition, the emulsion can be sensitized using reduction agents such as stannous salts as disclosed in U.S. Pat. No. 2,487,850 and so on. Further, the emulsions can contain a sensitizer such as a polyalkylene oxide derivative. Moreover, the emulsions can be spectrally-sensitized with cyanine or merocyanine dyes as disclosed in U.S. Pat. Nos. 2,519,001; 2,666,761; 2,734,900; 2,739,964; 3,481,742; and so on.

The silver halide emulsion employed in the present invention can contain antifogging agents such as mercury compounds, azaindenes, etc., stabilizing agents. The emulsion can also contain plasticizers such as glycerin, etc., and the above-described coating agents. Moreover, the emulsions can contain antistatic agents, ultraviolet light-absorbing agents, fluorescence-brightening agents, antioxidizing agents, dyes and the like.

In addition, the silver halide emulsion employed in the present invention can contain 2 or 4 equivalent color couplers. Preferred color couplers as used herein are the open-chain type ketomethylene yellow couplers such as benzoylacetanilide and pivaloylacetanilide type couplers, pyrazolone or indazolone magenta couplers, and phenolic or haphtholic cyan couplers.

Examples of suitable couplers which can be incorporated into the photographic silver halide emulsion layers of the photographic material of the invention are those described in U.S. Pat. Nos. 1,108,028; 2,186,849; 2,206,142; 2,343,702; 2,367,531; 2,369,489; 2,423,730; 2,436,130, 2,474,293; 2,600,788; 2,689,793; 2,738,658; 2,742,832; 2,808,329; 2,998,314; 3,046,129; 3,062,653; 3,265,506; 3,311,476; 3,408,194; 3,419,390; 3,419,391; 3,458,315; 3,476,563; 3,516,831and 3,617,291 and British Pat. No. 1,183,515.

The silver halide emulsion used in the present invention includes various kinds of silver halide photographic emulsions such as orthochromatic type emulsions, panchromatic emulsions, emulsions for infrared light photography, emulsions for X-ray photography, emulsions for other invisible light photography, enulsions for color photography; for example, color-coupler-containing emulsions, dye-developer-containing emulsions, and emulsions containing bleachable dyes; and so on.

The photographic light-sensitive material used in the present invention can be prepared in a conventional manner. The surface layer and the silver halide emulsion layers thereof can be formed using conventional coating methods such as a dipping method as disclosed in U.S. Pat. No. 3,335,026; etc., and an extrusion coating method as disclosed in U.S. Pat. No. 2,761,791; etc. Drying of the coated layers can be carried out in a conventional manner; for example, the layers can be dried with air whose temperature and humidity are adjusted to optimum conditions, under an infrared lamp, with micro-waves or using a combination of these methods, if desired.

The inorganic material employed in the present invention can be applied to all types of monochromatic or color photographic materials.

The inorganic material containing alumina-magnesium silicate as a main component which is used in the present invention improves the adhesion resistance of the surface layer of a photographic material without the aggregation of the inorganic material in a coating solution and a reduction in transparency of the surface layer thereof after photographic processings because this inorganic material has higher dispersibility and dispersion stability in an aqueous medium than known inorganic and organic matting agents have, and without the side-effect that static marks are produced.

The present invention will now be illustrated in greater detail by reference to the following examples. Unless otherwise indicated, all parts, percents, ratios and the like are by weight.

EXAMPLE 1

Four samples (1A), (1B), (1C) and (1D), were prepared by coating onto a polyethylene terephthalate film base in succession, a silver halide emulsion layer having the composition as shown in Table 1, and a protecting layer having one of the four different compositions as shown in Table 1.

Table 1

| Component | Emulsion Layer | Protecting Layer Sample (1A) | Sample (1B) | Sample (1C) | Sample (1D) |
|---|---|---|---|---|---|
| Binder | Gelatin (2.18 g/m²) + Potassium Polystyrene Sulfonate(molecular weight: 100,000) (0.30 g/m²) | Gelatin (1.75 g/m² + Phthaloylated Gelatin (phthaloylation degree : 95 mol %) (0.20 g/m²) | | | |
| Hardener | Sodium 2-Hydroxy-4,6-dichloro-S-triazine (0.5 g/ 100 g binder) | Sodium 2-Hydroxy-4,6-dichloro-S-triazine (0.4 g/ 100 g binder) | | | |
| Stabilizer | 1-Phenyl-5-mercaptotetrazole (0.5 g/ 100 g binder) + 1,4-Cyclohexanediol (1 g/ 100 g binder) | None | | | |
| Coating Assistant | None | Saponin (2 g/ 100 g binder) | | | |
| Silver Halide | Silver Iodobromide (5.00 g/m²) (containing 1.5 mol % of iodide) | None | | | |
| Matting Agent | None | None | Silica (silica particles of a mean diame- of 5 μ in aqueous medium) (3.5 g/100g binder | Polymethyl-Methacrylate (5 μ particles in aqueous medium) (3.5 g/100 binder) | Barasym NAS-100 (2 μ particles in aqueous medium (3.5 g/100 binder) |

Two pieces of light-sensitive films each measuring 4 × 5 centimeters were cut from each of the samples. They were kept for 2 days under the conditions of 40° C and 90% RH not in contact with each other for regulating the humidity. Then, one protecting layer was contacted with another protecting layer, under a load of 1 kg. They were kept for 1 day at 40° C and 90% RH. Each sample was then separated, and the area of adhesion was measured to evaluate the extent of adhesion. The results obtained are shown in Table 2.

The adhesion resistance of each sample was evaluated according to the following scale (hereinafter the same):

| Rank | Condition |
|---|---|
| A | 0 – 40 % of the area adhered |
| B | 41 – 60 % of the area adhered |
| C | 61 – 80 % of the area adhered |
| D | 80 % of the above the area adhered |

Samples, (1A), (1B), (1C) and (1D), were, without exposure, developed, fixed, washed with water and dried. The haze of the processed samples was determined. The results obtained are also shown in Table 2.

Table 2

| | Sample 1A | 1B | 1C | 1D |
|---|---|---|---|---|
| Adhesion Resistance | D | A | A | A |
| Haze* | 11.9 | 65.3 | 64.8 | 14.6 |

*Haze was measured by means of Integral Sphere Type Haze Meter (manufactured by Nippon Seimitsu Kogaku Co., Ltd.). A small haze indicates a high transparency.

Table 2 indicates that in the case of Sample (1A), which possesses a usual gelatin protecting layer as a surface layer, adhesion take place over nearly the entire area; in the case of Sample (1B) and (1C), wherein known matting agents are used, the adhesion resistance thereof was improved but haze was increased remarkably; and in the case of Sample (1D), the adhesion resistance thereof is improved, and that the haze is hardly increased. Namely, a photographic material having a surface layer which contains the compound of the present invention exhibits good adhesion resistance without damaging the transparency thereof.

EXAMPLE 2

Two pieces of light-sensitive films each measuring 4 × 5 centimeters were cut from each of Samples, (1A), (1B), (1C), and (1D), prepared as in Example 1, and the protecting layers of each were superposed upon each other. Each of these superposed samples were packed in lead foil laminated with a vinyl chloride-vinyl acetate copolymer film, followed by sealing with heat. They were kept for 3 days at a temperature of 50° C under a pressure of a 1 Kg load. The adhered areas of the resulting samples were measured, and the adhesion resistance thereof was evaluated. The results obtained are shown in Table 3.

Table 3

| | Sample | | | |
|---|---|---|---|---|
| | 1A | 1B | 1C | 1D |
| Adhesion Resistance | D | B | B | A |

The results obtained indicate that a photographic material containing the compound of the present invention exhibits higher adhesion resistance on storage under the conditions of high temperature than photographic materials containing known matting agents.

EXAMPLE 3

Adhesion tests were carried out as in Example 2 except that a protecting layer of one piece of the light-sensitive film was contacted with a film base of another piece of the light-sensitive film. The results obtained are shown in Table 4.

Table 4

| | Sample | | | |
|---|---|---|---|---|
| | 1A | 1B | 1C | 1D |
| Adhesion | C | B | B | A |

Table 4-continued

| | Sample | | | |
|---|---|---|---|---|
| | 1A | 1B | 1C | 1D |
| Resistance | | | | |

It can be also seen from Table 4 that the photographic material of the present invention has an excellent adhesion resistance.

EXAMPLE 4

Four samples, (4A), (4B), (4C) and (4D), were prepared by coating into a cellulose triacetate film base, in succession an antihalation layer, a red-sensitive silver halide emulsion layer, an intermediate layer, a green-sensitive silver halide emulsion layer, a yellow filter layer, a blue-sensitive silver halide emulsion layer, and one of the four different protecting layers whose compositions are shown in Table 5.

In each sample, the antihalation layer was a gelatin layer, into which black collodial silver was dispersed, containing a hardener (1) and a coating assistant (1); the red-sensitive silver halide emulsion layer contained a gelatin silver iodobromide emulsion (iodide content : 20 mol %), a sensitizing dye (2), a stabilizing agent (1), a hardener (2), a coating assistant (1), a coupler (4) and a coupler (5); the intermediate layer was a gelatin layer containing a hardener (1), a coating assistant (1) and a coating assistant (2); the green-sensitive silver halide emulsion layer contained a gelatin silver iodobromide (iodide content : 3.3 mol %), a sensitizing dye (1), a stabilizing agent (1), a hardener (2), a coating assistant (1), a coupler (2) and a coupler (3); the yellow filter layer was a gelatin layer, into which yellow collodial silver was dispersed, containing a hardener (1) and a coating assistant (1); and a blue-sensitive silver halide emulsion layer contained a gelatin silver iodobromide emulsion (iodide content : 3.3 mol %), a stabilizing agent (1), a hardener (2) and a coupler (1).

Additives employed for each layer was as follows:

| | |
|---|---|
| Sensitizing Dye (1) : | pyridinium salt of anhydro-5,5′-diphenyl-9-ethyl-3,3′-di(2-sulfoethyl)-oxacarbocyanine hydroxide |
| Sensitizing Dye (2) : | Pyridinium salt of anhydro-5,5′-dichloro-9-ethyl-3,3′-di(3-sulfopropyl)-thiacarbocyanine hydroxide |
| Stabilizing Agent (1) : | 4-hydroxy-6-methyl-1,3,3a,7-tetraazaindene |
| Hardner (1) : | sodium salt of 2-hydroxy-4,6-dichloro-S-triazine |
| Hardner (2) : | hexahydro-1,3,5-trivinylsulfonyl-S-triazine |
| Coating Assistant (1) : | sodium dodecylbenzene sulfonate |
| Coating Assistant (2) : | sodium bis(2-ethylhexyl)ester salt of 2-sulfosuccinic acid |
| Coupler (1) : | 2′-chloro-5′-[2-(2,4-di-tert-amyl-phenoxy)-butyramido]-α-(5,5-dimethyl-2,4-dioxo-3-imidazolidinyl)-α-(4-methoxybenzoyl)-acetanilide |
| Coupler (2) : | 1-(2,4,6-trichlorophenyl)-3-{3-[(2,4-di-tert-amylphenoxy)acetamido]-benzamido}-4-(4-methoxydiphenyl)azo-5-pyrozolone |
| Coupler (3) : | 1-(2,4,6-trichlorophenyl)-3-{3-[(2,4-di-tert-amylphenoxy)acetamido]-benzamido}-5-pyrazolone |
| Coupler (4) : | 1-hydroxy-4-(2-acetylphenyl)azo-N-[4-(2,4-di-tert-amylphenoxy)butyl]-2-naphthamide |
| Coupler (5) : | 1-hydroxy-N-dodecyl-2-naphthamide. |

Table 5

| Component | Sample 4A | 4B | 4C | 4D |
|---|---|---|---|---|
| Binder | Gelatin (0.9g/m²) + Sytrene-Maleic Acid Copolymer (intrinsic viscosity measured in a 1% aqueous solution of sodium chloride : 0.40) (0.4 g/m²) | | | |
| Hardner (1) | (0.8 g / 100 g of binder) | | | |
| Coating Assistant (1) | (3 g / 100 g of binder) | | | |
| Matting Agent | None | Calcium Carbonate(mean particle diameter of 5 μ in aqueous medium) (2.5g/100g binder) | Kaolin(mean particle diameter of 4μ in aqueous medium) (2.5g/100g binder | Bilt-Cote ( a mean particle diameter of 2 μ in aqueous medium) (2.5g/100g binder) |

Tests for examining the adhesion resistance and the haze of each of samples (4A), (4B), (4C) and (4D) were carried out as in Example 1. The results obtained are shown in Table 6.

Table 6

| | Sample 4A | 4B | 4C | 4D |
|---|---|---|---|---|
| Adhesion Resistance | D | B | B | A |
| Haze | 12.1 | 59.6 | 59.8 | 14.2 |

It can be seen from the results in Table 6 that a photographic material having a surface layer containing an inorganic material which contains alumina magnesium slicate as a main component used in the present invention has remarkably improved adhesion resistance which was attained without impairing the transparency thereof, compared with known photographic materials.

EXAMPLE 5

A back layer containing 0.8 g/m² of styrene-maleic anhydride copolymer (mean molecular weight : 70,000) and 0.6 g/m² of carbon black was each coated on the surface of the supports of samples, (1A) to (1D), as prepared in Example 1, this surface being opposite to the surface of the support having an emulsion layer thereon. They were designated samples (5A), (5B), (5C), and (5D) corresponding to (1A), (1B), (1C) and (1D), respectively.

Adhesion tests were carried out exactly as described in Example 2 except that a protecting layer of one piece of each sample was allowed to come into contact with a back layer of another piece thereof. The results obtained are shown in Table 7.

Table 7

| | Sample 5A | 5B | 5C | 5D |
|---|---|---|---|---|
| Adhesion Resistance | D | B | B | A |

It can be also seen from the results in Table 7 that the photographic material of the present invention has excellent adhesion resistance.

EXAMPLE 6

Three samples, (6A), (6B) and (6C), were prepared by coating onto one side of a cellulose triacetate film base in succession, a silver halide emulsion layer and a protecting layer, and coating onto the other side thereof a dyed-back layer. The compositions of each layer are shown in Table 8.

Table 8

| Component | Emulsion Layer | Protecting Layer | Back Layer Sample (6A) | Sample (6B) | Sample (6c) |
|---|---|---|---|---|---|
| Binder/ | Gelatin (14.3g/m²) | Gelatin (1.7g/m²)+ Potassium Polystyrene Sulfonate (mean molecular weight : 100,000) (0.2g/m²) | Gelatin (0.5g/m²) + Cellulose Diacetate (0.1g/m²) | | |
| Hardener | 2,3-Dihydroxy-5-methyl-1,4-dioxane (1.0 g/ 100 g binder) + Sodium Salt of 2-Hydroxy-4,6-dichloro-S-triazine (0.4 g/100 g binder) | | 2,3-Dihydroxy-5-methyl-1,4-dioxane (1.0 g / 100 g binder) | | |
| Coating Assistant | None | Sodium Dodecylbenzene Sulfonate (1.5g/100 g binder) | Sodium Dodecylbenzenesulfonate (2.0 g / 100 g binder) | | |
| Stabilizer | 4-Hydroxy-6-methyl-1,3,3a,7-tetrazaindene (0.6g/100g binder) | None | None | | |
| Silver | 5.0 g/m³* | None | None | | |
| Dye | None | None | (1), (2), (3) | | |
| Matting Agent | None | None | None | Polystyrene (mean particle diameter of 4 μ in aqueous medium) (1.5g/100g binder) | Veegum (mean particle diameter of 2 μ in aqueous medium) (1.5g/100g binder |

*Silver chloroiodobromide containing 0.1 mol % iodide, 25 mol % bromide and the remainder chlorideDye (1) Potassium salt of 4-(p-dimethylaminobenzylidene)-3-methyl-1-(p-sulfophenyl)-5-pyrazoloneDye (2) Potassium salt of 1-sulfophenyl-3-ethoxycarbonyl-5-pyrazolone methineoxonolDye (3) 1-(p-Sulfophenyl)-3-carboxy-5-pyrazolone pentamethineoxonol Adhesion tests were carried out exactly as described in Example 2 except that a protecting layer of one piece of each sample was allowed to come into contact with a back layer of another piece thereof. The results obtained are shown in Table 9.

Table 9

| | Sample | | |
|---|---|---|---|
| | 6A | 6B | 6C |
| Adhesion Resistance | D | C | B |

It can be also seen from the results in Table 9 that the photographic material of the present invention has excellent adhesion resistance.

EXAMPLE 7

Four samples, (7A), (7B), (7C) and (7D), were prepared by coating onto a polyethylene terephthalate film base in succession, a silver halide emulsion layer and a protecting layer. The composition of the silver halide emulsion layer of Example 7 are shown in Table 10.

Table 10

| Component | Sample (7A) | Sample (7B) | Sample (7C) | Sample (7D) |
|---|---|---|---|---|
| Binder | Gelatin (1.75 g/m²) + Phthaloylated Gelatin (phthaloylation degree : 95 mol %) (0.20 g/m²) | | | |
| Hardener | Sodium salt of 2-Hydroxy-4,6-dichloro-S-triazine (0.4 g/100 g binder) | | | |
| Coating Assistant | Saponin (2 g/100 g binder) | | | Potassium Salt of N-Propyl-(N-fluoro-octanesulfonyl)-glycine 1.8 g/100 g binder |
| Matting Agent | None | Barasym NAS-100 (a mean particle by diameter of 2 μ in aqueous medium) (2.5 g/100 g binder) | Cellulose Acetate Propionate (mean particle diameter of 4 μ in aqueous medium) (2.5 g/100g binder) | None |

For samples (7A) to (7D), adhesion tests were carried out under the same operating conditions as in Example 1.

The results obtained are shown in Table 11.

In addition, these samples were examined for the frequency of occurrence of static marks. Namely, after the samples were kept for 2 hours in a dark room under the conditions of 25° C and 30% RH in order to adjust the humidity thereof, they were closely adhered to an X-ray sensitized paper using a rubber roller, and then they were separated from the above paper. The separated samples were development-processed to examine the frequency of occurrence of static marks.

The results obtained are also shown in Table 11.

The frequency of the occurrence of static marks was evaluated according to the following scale:

| Rank | Condition |
|---|---|
| A | 0–20% of the area contained static marks |
| B | 21–40% of the area contained static marks |
| C | 41–60% of the area contained static marks |
| D | 61% or above of the area contained static marks |

Table 11

| | Sample | | | |
|---|---|---|---|---|
| | 7A | 7B | 7C | 7D |
| Adhesion Resistance | D | A | B | A |
| Static Mark Occurring Frequency | B | A | A | D |

It can be seen from Table 11 that sample (7D) containing the perfluoro compound in the surface layer had improved adhesion resistance, but had a high frequency of occurrence of static marks, compared with sample (7A) having a usual gelatin protecting layer; while sample (7B) containing the inorganic material of the present invention was improved in adhesion resistance, and had a lower frequency of static marks occurring.

EXAMPLE 8

Sample; (8A), (8B), (8C), (8D),8E), (8F) and (8G), were prepared by coating onto a cellulose triacetate film base a silver halide emulsion layer and a protecting layer in this order, the compositions of which are shown in Table 12.

Table 12

| Component | Emulsion Layer | Protecting Layer 8A | 8B | 8C | 8D | 8E | 8F | 8G |
|---|---|---|---|---|---|---|---|---|
| Binder | Gelatin 14.3 g/m² | Gelatin 1.9 g/m² | | | | | | |
| Hardener | Mucochloric acid (0.8 g/100 g binder + Dimethylol Urea (0.3 g/100 g binder) | Mucochloric Acid (0.8 g/100 g binder) + Dimethylol Urea (0.5 g/100 g binder) | | | | | | |
| Stabilizer | 4-Hydroxy-6-methyl-1,3,3a,7-tetrazaindene (0.6 g/100 g binder) | None | | | | | | |
| Silver | 7.0 g / m²= | None | | | | | | |
| Coating Assistant | None | Sodium Dodecylbenzenesulfonate (2 g / 100 g binder) | | | | | | |
| Matting Agent | None | Barasym NAS-100 [g/100g binder] (mean particle diameter of 1.5 μ | | | | | | |

Table 12-continued

| Component | Emulsion Layer | Protecting Layer 8A | 8B | 8C | 8D | 8E | 8F | 8G |
|---|---|---|---|---|---|---|---|---|
| | | in an aqueous medium) 1.0 | 2.5 | 5.0 | 10 | 15 | 25 | None |

*A silver iodobromide emulsion containing 5 mol % iodide

The adhesion resistance and haze of each of the samples, (8A)–(8G), were examined by the same procedures as in Example 2. The results obtained are shown in Table 13.

Table 13

| | Sample 8A | 8B | 8C | 8D | 8E | 8F | 8G |
|---|---|---|---|---|---|---|---|
| Adhesion Resistance | C | A | A | A | A | A | D |
| Haze | 12.0 | 12.2 | 14.3 | 16.8 | 18.2 | 28.5 | 12.0 |

Table 13 indicates that even when one gram of the inorganic material of the present invention per 100 g of binder in a surface layer was added, improvement in adhesion resistance of the surface was observed, and not less than 2.5 g of the content thereof results in a sufficient improvement in adhesion resistance.

EXAMPLE 9

Samples (9A), (9B), (9C) and (9D) were prepared by coating onto one side of a cellulose triacetate film base in succession, a silver halide emulsion layer and a protecting layer, and coating a back layer on the other side thereof.

The composition of the silver halide emulsion layer of the above samples was the same as that of the emulsion layer of Example 6. The composition of the protecting layer of sample (9A) was the same as that of Example 6, and the composition of the back layer of sample (9A) was the same as that of sample (6A) in Example 6. The composition of the protecting layer of sample (9B) was the same as that of Example 6, and the composition of the back layer of sample (9B) contained 5 g of Barasym NAS-100 (mean particle diameter of 2 $\mu$ in an aqueous medium) per 100 g of binder in addition to the composition of the back layer of sample (6A). The composition of the protecting layer of sample (9C) contained 5 g of Barasym NAS-100 (mean particle diameter of 2 $\mu$ in an aqueous medium) per 100 g of binder in addition to the composition of the protecting layer in Example 6, and the composition of the back layer was the same as that of sample (6A) in Example 6. The composition of the protecting layer of Sample (9D) contained 5 g of Barasym NAS-100 (mean particle diameter of 2 $\mu$ in an aqueous medium) per 100 g of binder in addition to that of Example 6, and the composition of the back layer contained 5 g of Barasym NAS-100 (mean particle diameter of 2 $\mu$ in an aqueous medium) per 100 g of binder in addition to that of sample (6A) in Example 6.

The adhesion resistance was examined exactly as described in Example 2 except that the protecting layer of one piece of each sample was allowed to come into contact with the back layer of another piece thereof. the results obtained are shown in Table 14.

Table 14

| | Sample 8A | 8B | 8C | 8D |
|---|---|---|---|---|
| Adhesion Resistance | D | B | A | A |

It can be seen from the results in Table 14 that photographic materials containing the inorganic material of the present invention in at least one of the surface layer exhibits excellent adhesion resistance. Needless to say, the inorganic material of the present invention can be contained in both of the surface layers as shown in sample (8D).

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support having thereon at least one silver halide emulsion layer and a surface disposed upon a silver halide emulsion layer consisting essentially of a binder containing an inorganic materials of which the main component is alumina-magnesium silicate having the following composition

| | | |
|---|---|---|
| $SiO_2$ | about 30 | – about 90 wt % |
| MgO | about 1 | – about 40 wt % |
| $Al_2O_3$ | about 0.5 | – about 20 wt % |

wherein the total of their contents is in the range of about 70 to 100 wt%, said inorganic material having a particle size when dispersed in water about 0.3 to 10 microns.

2. The photographic light-sensitive material of claim 1, wherein said alumina-magnesium silicate has the following composition

| | |
|---|---|
| $SiO_2$ | 40 – 70 wt % |
| MgO | 10 – 35 wt % |
| $Al_2O_3$ | 0.5 – 10 wt% |

wherein the total of their contents is in the range of 75 to 100 wt.%.

3. The photographic light-sensitive material of claim 1, wherein said inorganic material includes a small amount of $Na_2O$, $K_2O$, CaO, BaO, $TiO_2$, $Fe_2O_3$, and/or water.

4. The photographic light-sensitive material of claim 1, wherein said inorganic material has a particle size when dispersed in water ranging from 0.5 to 3 microns.

5. The photographic material of claim 1 wherein the binder is gelatin.

6. The photographic light-sensitive material of claim 1, wherein said inorganic material is present in said surface layer in an amount of at least about 1 g per 100 grams of said binder.

7. The photographic light-sensitive material of claim 6, wherein said the amount of said inorganic material ranges from about 2.5 grams to about 15 grams per 100 grams of the binder.

* * * * *